US006668686B1

(12) United States Patent
Hsien

(10) Patent No.: US 6,668,686 B1
(45) Date of Patent: Dec. 30, 2003

(54) INNER PERIPHERY OF A DRIVING MEMBER FOR DRIVING NUT WITH DIFFERENT SPECIFICATIONS

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/167,454

(22) Filed: Jun. 13, 2002

(51) Int. Cl.[7] ..... B25B 13/48
(52) U.S. Cl. ..... 81/60; 81/119; 81/176.1
(58) Field of Search ..... 81/60, 176.1, 176.2, 81/119, 121.1

(56) References Cited

U.S. PATENT DOCUMENTS 5,832,792 A * 11/1998 Hsieh ..... 81/124.6
5,860,339 A * 1/1999 Mikic et al. ..... 81/186
5,904,076 A * 5/1999 Siwy ..... 81/121.1
6,079,299 A * 6/2000 Sundstrom ..... 81/121.1
6,098,501 A * 8/2000 Sundstrom ..... 81/121.1
6,263,767 B1 * 7/2001 Hu ..... 81/60
6,282,992 B1 * 9/2001 Hu ..... 81/63.2

FOREIGN PATENT DOCUMENTS

EP 236630 A1 * 9/1987 ..... B25B/13/06

* cited by examiner

*Primary Examiner*—Joseph J. Hail, III
*Assistant Examiner*—David B. Thomas
(74) *Attorney, Agent, or Firm*—Rosenberg, Klein & Lee

(57) ABSTRACT

A driving member for a wrench tool includes a ring-shaped body having a hole defined therethrough and six concavities are defined equiangularly in an inner periphery of the ring-shaped body. Six engaging portions are located between the six concavities alternatively and each engaging portion includes a first engaging surface and a second engaging surface on two ends of the engaging portion. The two engaging surfaces are respectively matched with two respective sides of the nuts having different specifications.

3 Claims, 6 Drawing Sheets

INNER PERIPHERY OF A DRIVING MEMBER FOR DRIVING NUT WITH DIFFERENT SPECIFICATIONS

FIELD OF THE INVENTION

The present invention relates to an improved inner periphery for a wrench wherein two protrusions are located between adjacent recesses in the inner periphery of the driving member.

BACKGROUND OF THE INVENTION

A conventional driving member for driving but or bolt bead with hexagonal periphery generally includes a six surfaces and six concavities are located between the adjacent surfaces such that the six sides of the nut are matched with the six surfaces and can be rotated. However, there are two different systems for the specifications of the nuts, for example, a 11/16 inch nut is slightly different from a 17-mm nut. There is 0.28 mm in difference for the two nuts so that when the driving member is used to tighten or loosen the two nuts, there will be a gap defined between the inner periphery of the driving member and the nut Several efforts are developed for overcoming the problems such as the disclosures shown in U.S. Pat. Nos. 4,765,211, 3,903,764, 5,388,486, and 5,219,392. Most of the efforts use a protrusion at a specific position of the inner periphery of the driving member so that the nuts with different specifications can be secured by the driving member. Nevertheless, the protrusion tends to be worn out because it protrudes along and bears a huge stress frequently. The tool has to be removed from the nut and turned to the other side to match the nut again when using the tool in opposite direction.

The present invention intends to provide a driving member that has an improved inner periphery to accommodate the nuts with different specifications.

SUMMARY OF THE INVENTION

In accordance with one aspect of the present invention, there is provided a driving member which includes a ring-shaped body having a hole defined therethrough and six concavities are defined equiangularly in an inner periphery of the ring-shaped body. Six engaging portions are located between the six concavities alternatively and each engaging portion includes a first engaging surface and a second engaging surface on two ends of the engaging portion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
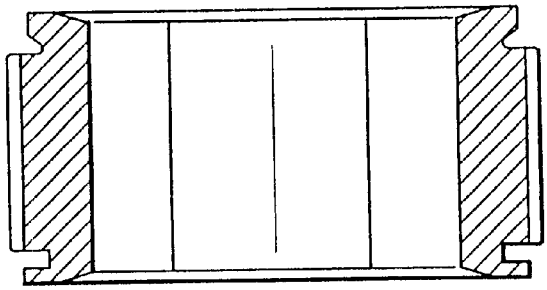
FIG. 1 is an exploded view to show the driving member of the present invention and a tool.
Figure 1:
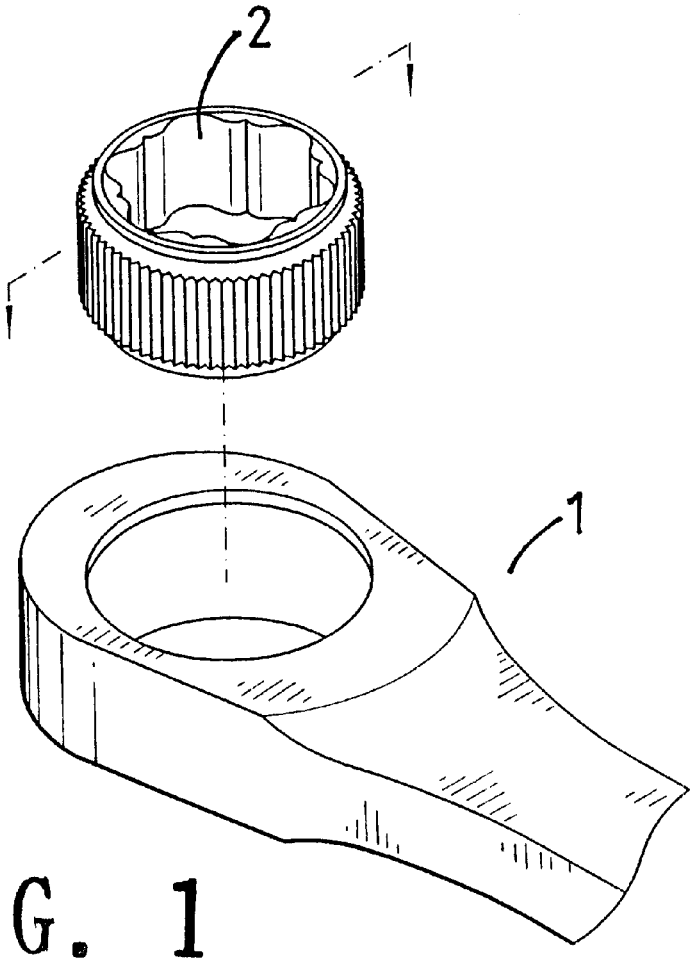
Figure 2:
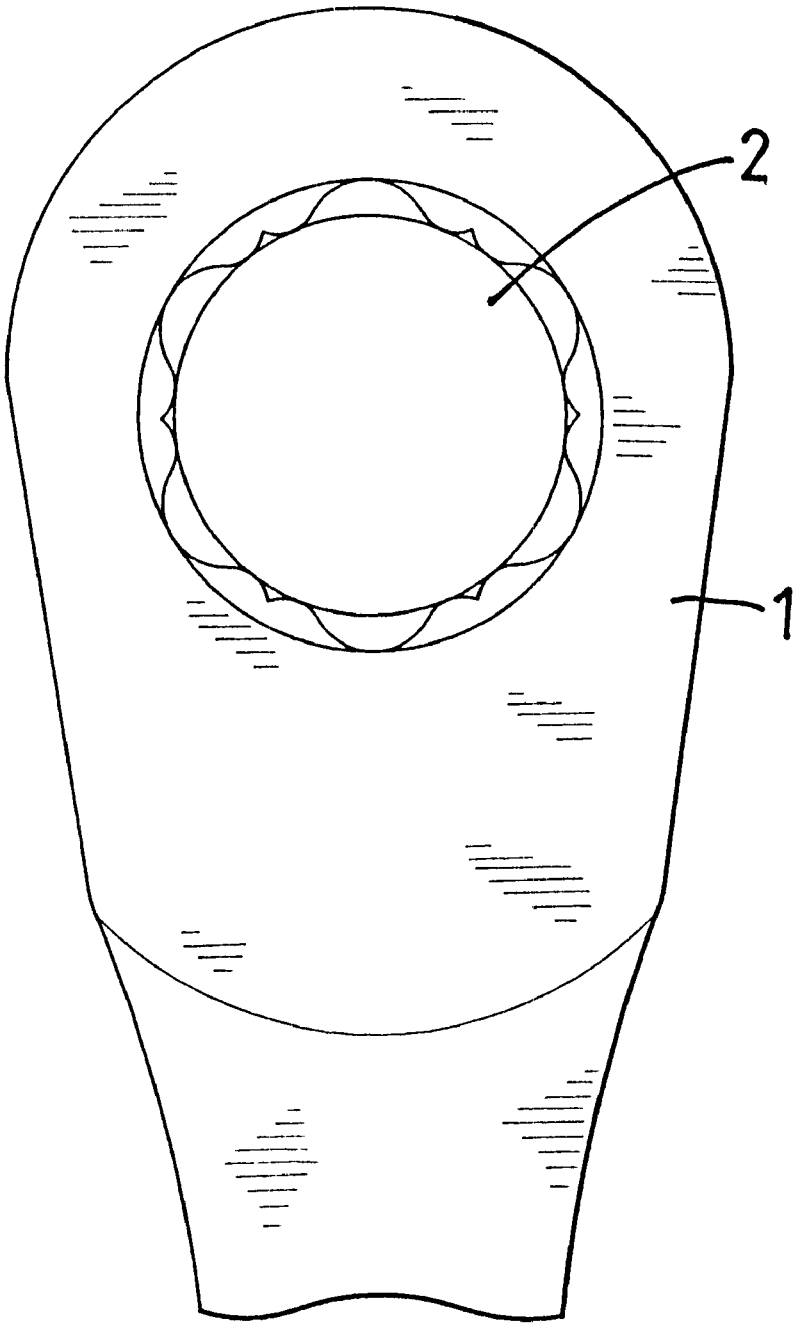
FIG. 2 shows the driving member be accommodated in the tool.
Figure 3:
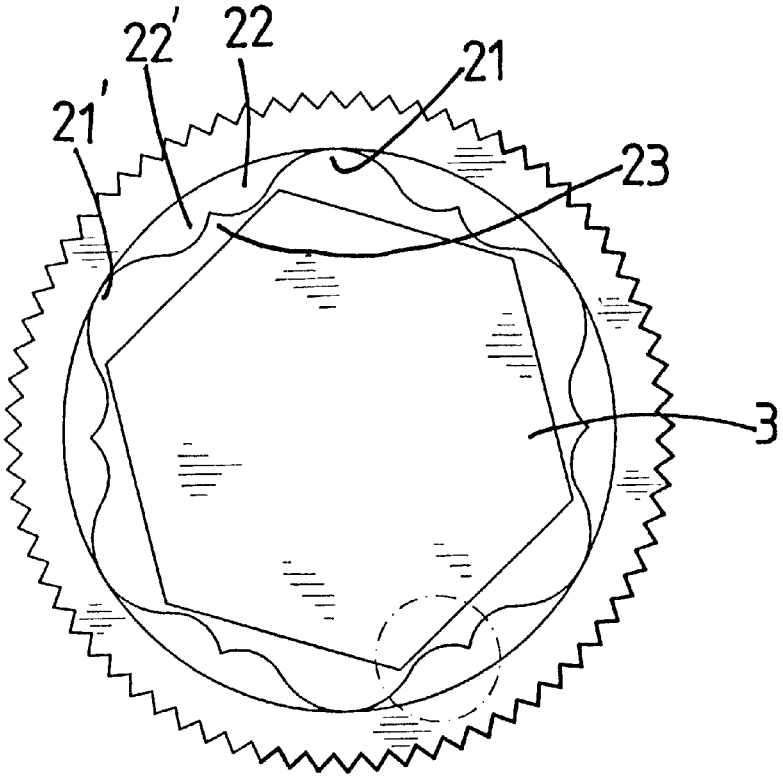
FIG. 3 shows a nut is accommodated in the hole of the driving member.
Figure 3:
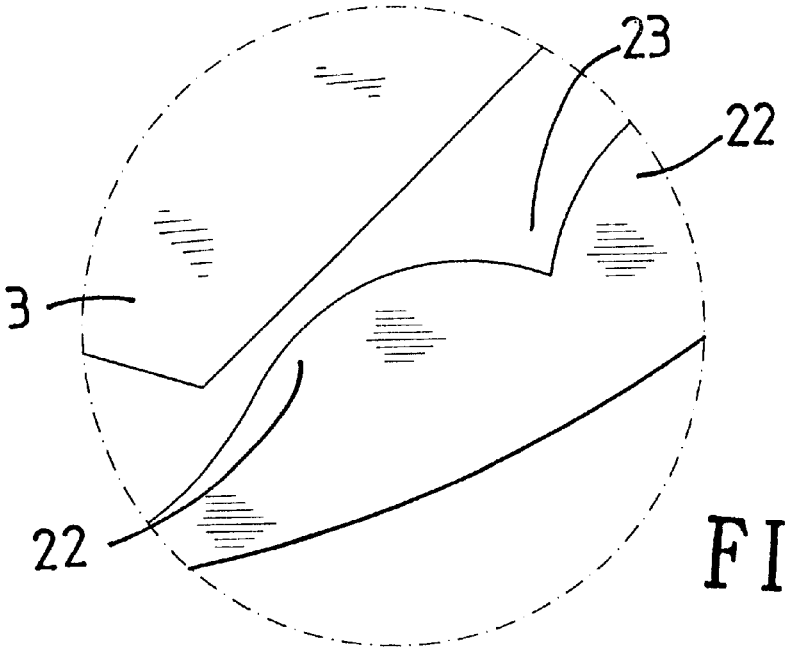

Referring to FIGS. 1 to 3, the driving member of the present invention comprises a ring-shaped body which is received in a box-end wrench 1 and teeth are defined in an outer periphery of the ring-shaped body. A hole 2 is defined through the body and six concavities 21 are defined equiangularly in an inner periphery of the ring-shaped body. Six engaging portions are located between the six concavities 21 alternatively and each engaging portion includes a first protrusion 22 and a second protrusion 22'. A recess 23 is defined between the first protrusion 22 and the second protrusion 22'.

A nut 3 is accommodated in the hole 2 of the body and either one of the first protrusion 22 or the second protrusion 22' contacts a side of the nut 3.

Figure 4:
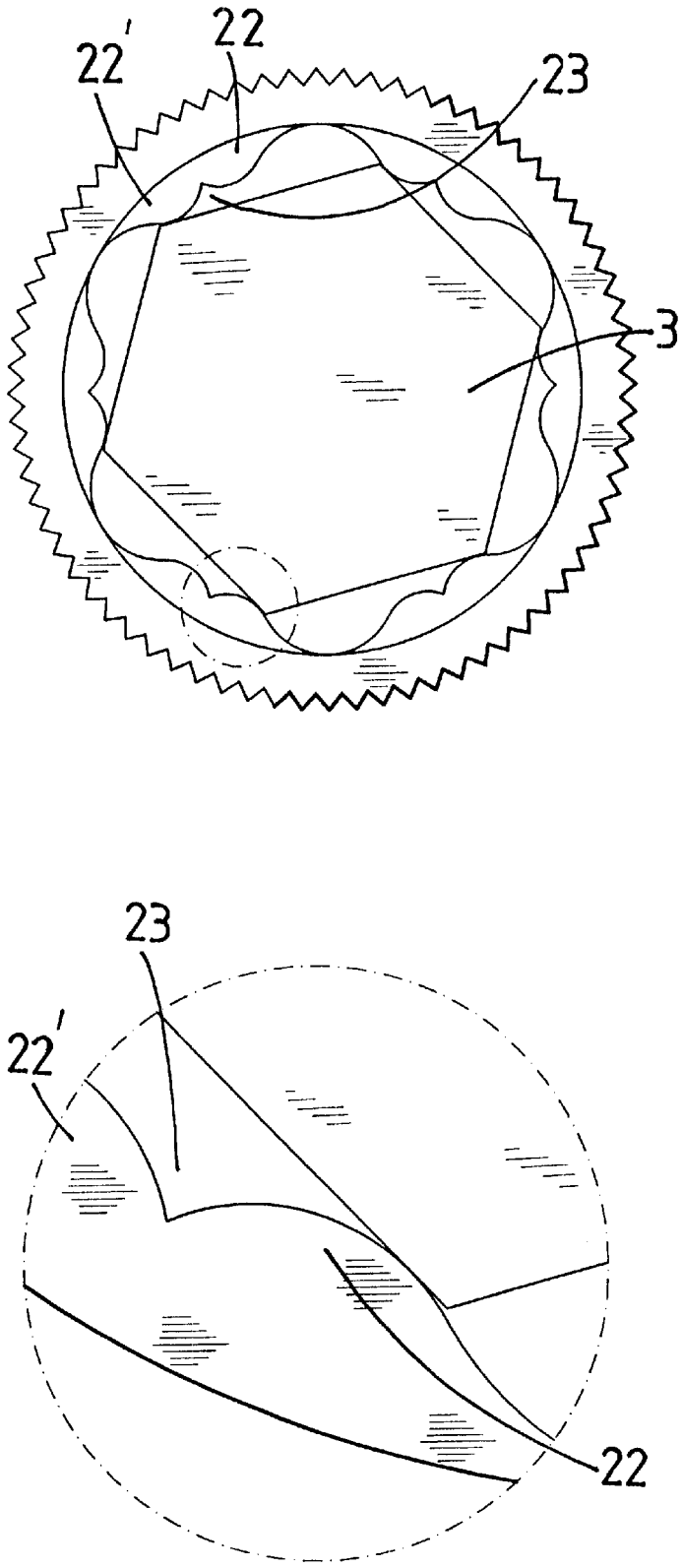
FIG. 4 shows the driving member is rotated counter clockwise to drive the nut.

As shown in FIG. 4, when the wrench 1 is to be rotated counter clockwise, the six second protrusions 22' respectively contact respective one of the six sides of the nut 3 so that when the wrench 1 is rotated counter clockwise, the nut 3 is rotated.

Figure 5:
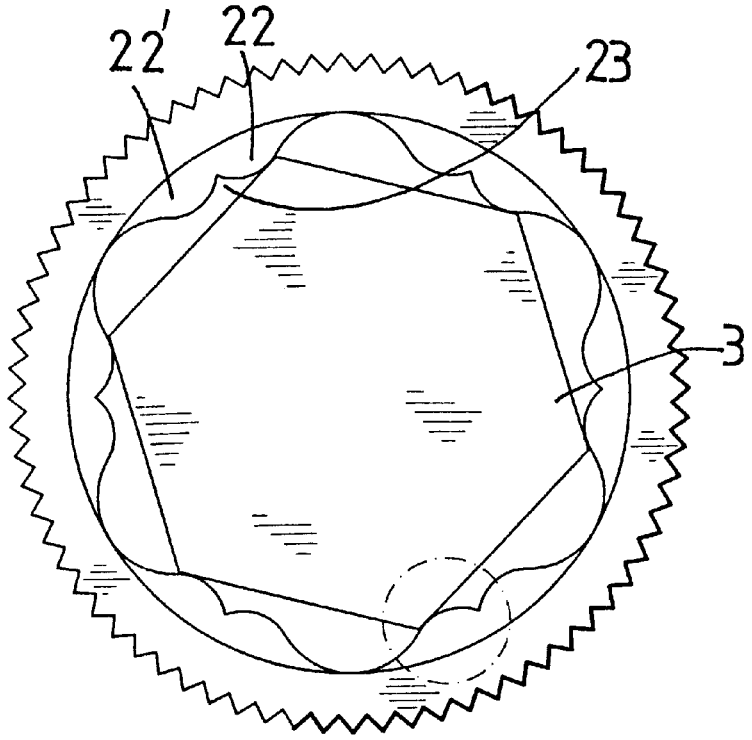
FIG. 5 shows the driving member is rotated clockwise to drive the nut.
Figure 5:
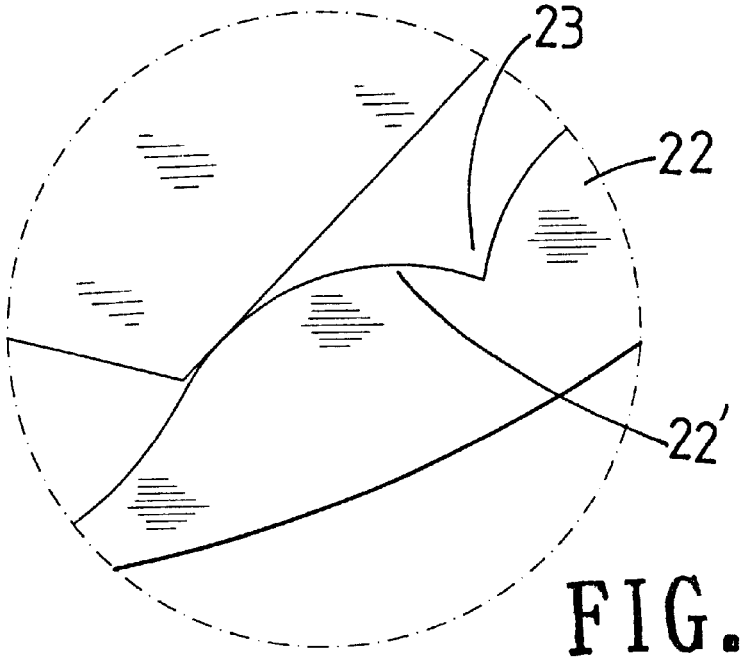

Referring to FIG. 5, when the wrench 1 is to be rotated clockwise, the body is adjusted to let six first protrusions 22 respectively contact respective one of the six sides of the nut 3 so that when the wrench 1 is rotated clockwise, the nut 3 is rotated.

The concavities 21 allow the nuts with different specifications to be accommodated in the hole 2 of the driving member so that the driving member can be used to rotate the nuts 3 with two specifications. Referring to FIG. 4, the distance "A" is short so that the user may adjust the wrench 1 quickly to match the nuts 3.

Figure 6:
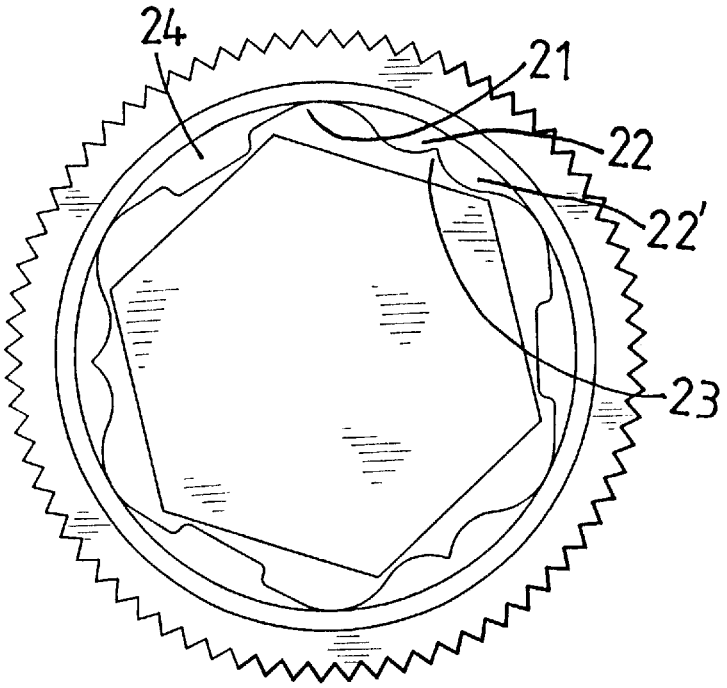
FIG. 6 shows another embodiment of the inner periphery of the driving member.
Figure 6:
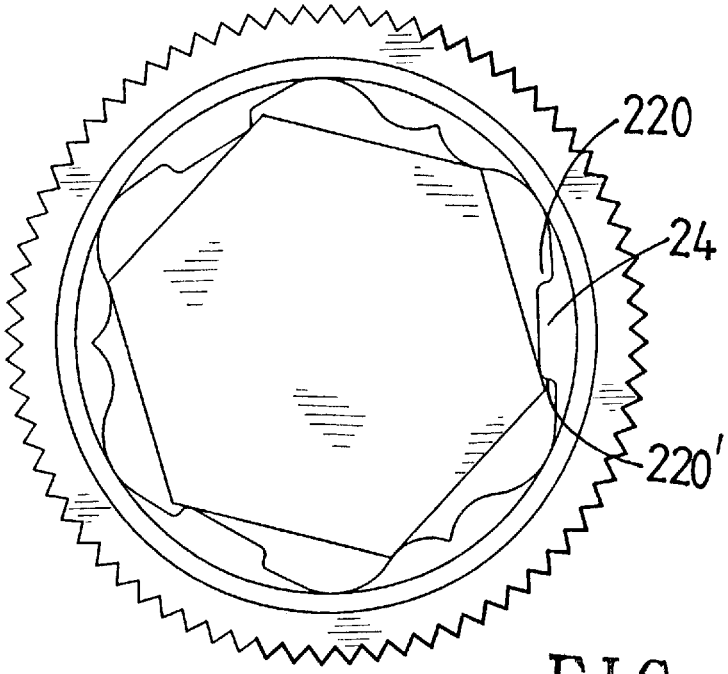

FIG. 6 shows that some of the engaging portions can be simply a rectangular protrusion 24 which includes a first engaging surface 220 and a second engaging surface 220' on two ends thereof.

While we have shown and described the embodiment in accordance with the present invention, it should be clear to those skilled in the art that farther embodiments may be made without departing from the scope of the present invention.

What is claimed is:

1. A driving member comprising:

a ring-shaped body having a hole defined therethrough, six concavities defined equiangularly in an inner periphery of the ring-shaped body, six engaging portions located between the six concavities alternatively and three of the six engaging portions each being a single rectangular protrusion protruding from an intermediate portion of the engaging portion, each rectangular protrusion including a first engaging surface and a second engaging surface on two ends thereof.

2. The driving member as claimed in claim 1, wherein the other three engaging portions each include a first protrusion and a second protrusion, a recess defined between the first protrusion and the second protrusion.

3. A driving member comprising:

a ring-shaped body having a hole defined therethrough, six concavities defined equiangularly in an inner periphery of the ring-shaped body, six engaging portions located between the six concavities alternatively and each engaging portion being composed of a first protrusion and a second protrusion, a recess defined between the first protrusion and the second protrusion, each concavity being located and continuously connected between the first protrusion and the second protrusion.

* * * * *